US008369551B2

(12) United States Patent
Kornagel

(10) Patent No.: US 8,369,551 B2
(45) Date of Patent: Feb. 5, 2013

(54) HEARING AID WITH WIRELESS SIGNAL TRANSMISSION

(75) Inventor: Ulrich Kornagel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 951 days.

(21) Appl. No.: 12/380,944

(22) Filed: Mar. 5, 2009

(65) Prior Publication Data

US 2009/0226014 A1 Sep. 10, 2009

(30) Foreign Application Priority Data

Mar. 7, 2008 (DE) ..... 10 2008 012 993

(51) Int. Cl.
*H04R 25/00* (2006.01)

(52) U.S. Cl. ..... 381/315; 375/247

(58) Field of Classification Search ..... 375/247; 381/315

See application file for complete search history.

(56) References Cited

U.S. PATENT DOCUMENTS

| | | | | |
|---|---|---|---|---|
| 6,839,387 | B1 * | 1/2005 | Mittel | 375/247 |
| 2004/0214563 | A1 | 10/2004 | Chen | |

FOREIGN PATENT DOCUMENTS

| | | | |
|---|---|---|---|
| DE | 602004006912 | T2 | 2/2008 |
| EP | 1142450 | B1 | 3/2003 |
| WO | WO 0223948 | A1 | 3/2002 |
| WO | WO 2007068243 | A1 | 6/2007 |

* cited by examiner

*Primary Examiner* — Jerome Jackson, Jr.
*Assistant Examiner* — Dale E Page

(57) ABSTRACT

A hearing aid with wireless signal transmission is provided which includes a radio reception unit for wireless reception of modulated and/or coded audio signals, a device to estimate the reception quality of the received audio signal, a device to generate an acoustic limit signal whose level increases when the estimated reception quality of the received audio signal decreases, a device to heterodyne a demodulated and/or decoded audio signal with the limit signal, and a device to output the audio signal heterodyned with the limit signal to a hearing aid wearer. To generate a limit signal, the hearing aid includes a device to generate an impulse response and a device to perform the operation of convolving the demodulated and/or decoded audio signal with the impulse response. This convolution produces a desired signal which appears closer to the hearing aid wearer when the estimated reception quality is better.

9 Claims, No Drawings

HEARING AID WITH WIRELESS SIGNAL TRANSMISSION

CROSS REFERENCE TO RELATED APPLICATIONS

This application claims priority of German application No. 10 2008 012 993.3 DE filed Mar. 7, 2008, which is incorporated by reference herein in its entirety.

FIELD OF INVENTION

The present invention relates to an improved hearing aid with wireless signal transmission.

BACKGROUND OF INVENTION

Hearing aids are technical instruments which compensate for congenital or acquired hearing impairments which are not amenable to causal therapy. Hearing aids amplify and modulate the sound, i.e. the acoustic signal, upstream of the ear's actual sense organ, the inner ear. Various types of device are available, comprising a microphone, signal processor (e.g. amplifier), energy source and receiver.

Already known for some time are hearing aids having radio reception units which receive modulated and/or coded audio signals from a transmitter, demodulate and/or decode them and output them suitably processed (mainly amplified) to the hearing aid wearer as sound waves. Such systems are used, for example, in public buildings such as churches, or also in the hearing aid wearer's living area, in order to feed certain types of sound information to the hearing aid not only via sound waves but directly into the hearing system via radio.

Some of these systems use a coding which, in the event of transmission errors, produce unpleasant sounding noises, so-called artifacts, e.g. loud bleeping or clicking noises, before sufficient information for correct decoding is available to the decoder again after the transmission error. A frequent cause of transmission errors is an excessively weak signal reaching the receiver, e.g. because the hearing aid wearer has moved too far away from the transmitter.

DETAILED DESCRIPTION OF INVENTION

The object of the present invention is to specify a hearing aid with wireless signal transmission, enabling unpleasant artifacts resulting from transmission errors due to increasing distance from a transmitter to be avoided.

This object is achieved by a hearing aid with a radio reception unit for wireless reception of modulated and/or coded audio signals, comprising the following:

- means of estimating the reception quality of the received audio signals;
- means of generating an acoustic limit signal whose strength, i.e. level, increases when the estimated reception quality of received audio signals decreases;
- means of heterodyning a demodulated and/or decoded audio signal with the limit signal; and
- means of outputting the audio signal heterodyned with the limit signal to a hearing aid wearer.

Means can also be provided for reducing a level of the demodulated and/or decoded audio signal when the estimated reception quality of the received audio signals decreases.

An acoustic noise signal or an acoustic hum signal or any other unpleasant sounding signal can be used as the limit signal.

In an exemplary embodiment, the means of generating the limit signal can include the following:

- means of generating a synthetic room impulse response as a function of the reception quality such that convolution of the limit signal with the synthetic room impulse response produces a resulting limit signal which appears spatially nearer, the poorer the estimated reception quality; and
- means of performing the operation of convolving the limit signal with the synthetic room impulse response.

Additionally or alternatively, the following can be provided for generating a limit signal:

- means of generating an impulse response as a function of the reception quality such that convolution of the demodulated and/or decoded audio signal with the impulse response produces a resulting wanted signal which appears spatially nearer, the better the estimated reception quality; and
- means of performing the operation of convolving the demodulated and/or decoded audio signal with the impulse response.

The invention also relates to a corresponding method for controlling the signal processing of a hearing aid.

An advantage of the present invention is to be seen in that decreasing reception quality is communicated to the hearing aid wearer in an intuitive manner by amplifying the limit signal with increasing deterioration of reception quality and simultaneously or alternatively fading the wanted signal, i.e. the demodulated and/or decoded audio signal, into the background.

Exemplary embodiments of the present invention will now be explained in greater detail.

In the case of the hearing aids with radio reception units mentioned in the introduction, the reception quality of the signal depends, among other things, on the spatial distance of the hearing aid (and therefore of the hearing aid wearer) from the transmitter. When a critical distance is exceeded, reception quality is so poor that correct recovery of the (wanted) audio signal from the received modulated and/or coded signal is no longer possible. Depending on the relevant spatial conditions, e.g. walls and their constitution, a spatial bubble is thus defined within which interference-free reception is possible and outside of which this cannot be guaranteed.

In a hearing aid according to the invention, the reception quality of modulated and/or coded audio signals received is continuously monitored (e.g. periodically every 100 ms), the reception quality being derivable e.g. from the channel coding. The signal quality can be numerically evaluated, e.g. in the interval 0 . . . 1, where 0 indicates a no longer usable signal and 1 a best possible signal.

In a first embodiment of the invention, a synthetic acoustic signal, hereinafter referred to as a limit signal, is generated and heterodyned with the demodulated and/or decoded wanted) audio signal, the level of the limit signal being dependent on the signal quality, namely such that the level of the limit signal increases with declining reception quality, so that outside said spatial bubble the limit signal is injected with maximum level. It is therefore signaled to the hearing aid wearer by means of the limit signal that he is moving out of the reception area of a particular transmitter, whereupon the hearing aid wearer can, for example, deactivate the hearing aid's radio reception or return in the direction of better reception.

In addition, with declining reception quality the level of the demodulated and/or decoded (wanted) audio signal can be reduced in order to prevent unpleasant noise artifacts from being output to the hearing aid wearer if the latter does not deactivate the hearing aid's radio reception on leaving the spatial bubble.

Particularly suitable as a limit signal are signals which do not constitute a distinct tone, i.e. noise signals or hum signals, for example.

In other embodiments of the invention, the limit signal and/or the wanted audio signal are convolved with suitable impulse responses in order to produce an acoustic spatial impression which corresponds to the movement out of the reception area.

For this purpose the limit signal can be convolved with a synthetic room impulse response so that the limit signal seems louder and more direct (i.e. spatially nearer), the closer the receiver is to a limit of the spatial bubble, i.e. the poorer the estimated reception quality. The hearing aid wearer is therefore given the impression of approaching an acoustic barrier, the aim again being that, for example, he deactivate the hearing aid's radio reception or move again in the direction of better reception. Methods for generating suitable room impulse responses will be familiar to the average person skilled in the art of digital audio signal processing.

Similarly, the wanted signal can alternatively or additionally be convolved with an impulse response which causes the wanted signal to appear quieter and more indirect (also spatially more distant) the closer the receiver is to a limit of the spatial bubble, i.e. the poorer the estimated reception quality. The hearing aid wearer is therefore given the (correct) impression of going away from the signal source, an impression which he would not get from modern coding methods, as the latter, thanks to error correction mechanisms, generally operate without audible deterioration up to a certain distance from the transmitter, but cease relatively abruptly to provide usable results beyond that limit.

Numerous variants and embodiments of the invention described are conceivable. For example, the hearing aid can be configured such that the impressing of the limit signal and/or the reducing of the wanted signal level only take effect when the reception quality has deteriorated to a certain degree, e.g. in order to prevent the hearing aid wearer from experiencing a fluctuating signal in the event of comparatively small movements in the interference-free or minimally disturbed reception region.

The invention claimed is:

1. A hearing aid having a microphone and an amplification unit for amplifying microphone signals, comprising:

a radio reception unit for wireless reception of a modulated and/or coded audio signal, comprising:

an estimating device to estimate a reception quality of the received modulated and/or coded audio signal;

a generating device to generate an acoustic limit signal, a level of the acoustic limit signal increases when the estimated reception quality of the received modulated and/or coded audio signal decreases;

a heterodyning device to heterodyne a demodulated and/or decoded audio signal with the acoustic limit signal; and an outputting device to output an audio signal heterodyned with the acoustic limit signal to a hearing aid wearer, wherein the generating device comprises:

a second generating device to generate a synthetic room impulse response as a function of the estimated reception quality, such that a convolution of the acoustic limit signal with the synthetic room impulse response produces a resulting limit signal, the resulting limit signal appears louder and therefore closer to the hearing aid wearer when the estimated reception quality of the modulated and/or coded audio signal is poor; and a convolving device to perform an operation of convolving the acoustic limit signal with the synthetic room impulse response.

2. The hearing aid as claimed in claim 1, wherein a level of the demodulated and/or decoded audio signal is reduced when the estimated reception quality of the received modulated and/or coded audio signal decreases.

3. The hearing aid as claimed in claim 1, wherein the acoustic limit signal is an acoustic noise signal.

4. The hearing aid as claimed in claim 1, wherein the acoustic limit signal is an acoustic hum signal.

5. The hearing aid as claimed in claim 1, further comprising:

a third generating device to generate an impulse response as a function of the estimated reception quality such that a convolution of the demodulated and/or decoded audio signal with the impulse response produces a desired output audio signal, the desired output signal appears louder and therefore closer to the hearing aid wearer when the estimated reception quality of the modulated and/or coded audio signal is better; and a second convolving device to perform the operation of convolving the demodulated and/or decoded audio signal with the impulse response.

6. The hearing aid as claimed in claim 1, wherein a reception quality of the received modulated and/or coded audio signal is monitored periodically, and wherein a signal quality is numerically evaluated in an interval.

7. The hearing aid as claimed in claim 6, wherein periodic monitoring is every 100 ms.

8. The hearing aid as claimed in claim 6, wherein the interval is between 0 and 1, with 0 indicating an unusable signal and 1 a best possible signal.

9. The hearing aid as claimed in claim 1, wherein increasing the acoustic limit signal and/or reducing the desired output audio signal only takes effect when the estimated reception quality has deteriorated to a specifically defined level.

* * * * *